US006328430B1

(12) United States Patent
Ahn et al.

(10) Patent No.: US 6,328,430 B1
(45) Date of Patent: Dec. 11, 2001

(54) MICRO-INJECTING DEVICE

(75) Inventors: Byung-sun Ahn, Kyonggi-do (KR); Zukov Andrey Aleksandrovich; Dunaev Boris Nikolaevich, both of Moscow (RU)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/432,098

(22) Filed: Nov. 2, 1999

(30) Foreign Application Priority Data

Nov. 3, 1998 (RU) ..... 98120457

(51) Int. Cl.[7] ..... B41J 2/05
(52) U.S. Cl. ..... 347/65
(58) Field of Search ..... 347/65, 67, 54, 347/55; 430/106.6; 216/27

(56) References Cited

U.S. PATENT DOCUMENTS 4,480,259 10/1984 Kruger et al. .
4,490,728 12/1984 Vaught et al. .
4,609,427 * 9/1986 Inamoto et al. ..... 216/27
4,809,428 3/1989 Aden et al. .
5,140,345 8/1992 Komuro .
5,274,400 12/1993 Johnson et al. .
5,420,627 5/1995 Keefe et al. .
6,074,043 * 6/2000 Ahn ..... 347/54
6,084,603 * 7/2000 Arai et al. ..... 347/2
6,165,663 * 12/2000 Baba et al. ..... 430/106.6

* cited by examiner

*Primary Examiner*—N. Le
*Assistant Examiner*—K. Feggins
(74) *Attorney, Agent, or Firm*—Robert E. Bushnell, Esq.

(57) ABSTRACT

Disclosed is a micro-injecting device in which a cohesion promoting layer is formed between a protective layer and a heating chamber barrier layer. The cohesion promoting layer is formed using γ-aminopropyltriethoxysilane. The cohesion promoting layer is capable of enhancing the cohesion of the protective layer and the heating chamber barrier layer and thereby enhancing the general injecting performance of the micro-injecting device.

16 Claims, 2 Drawing Sheets

MICRO-INJECTING DEVICE

CLAIM OF PRIORITY

This application makes reference to, incorporates the same herein, and claims all benefits accruing under 35 U.S.C. §119 from an application for MICRO-INJECTING DEVICE earlier filed in the Russian Federation Patent Office on the Nov. 3rd 1998 and there duly assigned Ser. No. 98120457.

BACKGROUND OF THE INVENTION

1. Field of the Invention

The present invention relates to the field of micro-injecting devices, and more particularly to the cohesion of a protective layer and a heating chamber barrier layer in a micro-injection device.

2. Description of the Related Art

Generally, a micro-injecting device refers to a device which is designed to provide printing paper, a human body or motor vehicles with a predetermined amount of liquid, for example, ink, injection liquid or petroleum using the method in which a predetermined amount of electric or thermal energy is applied to the above-mentioned liquid, yielding a volumetric transformation of the liquid. This method allows the application of a small quantity of a liquid to a specific object.

The inkjet printer is a form of micro-injecting device which differs from conventional dot printers in the capability of performing print jobs in various colors by using cartridges. Additional advantages of inkjet printers over dot printers are lower noise and enhanced quality of printing. For these reasons, use of inkjet printers is increasing.

An ink-jet printer includes a printhead with a plurality of nozzles having a minute diameter. The printhead performs a printing performance by bubbling and expanding an ink and spraying the ink on a printing paper.

Examples of the construction and operation of several ink jet print heads of the conventional art are seen in the following U.S. patents. U.S. Pat. No. 4,490,728, to Vaught et al., entitled Thermal Ink Jet Printer, describes a basic print head. U.S. Pat. No. 4,809,428, to Aden et al., entitled Thin Film Device For An Ink Jet Printhead and Process For Manufacturing Same and U.S. Pat. No. 5,140,345, to Komuro, entitled Method Of Manufacturing a Substrate For A Liquid Jet Recording Head And Substrate Manufactured By The Method, describe manufacturing methods for ink-jet printheads. U.S. Pat. No. 5,274,400, to Johnson et al., entitled Ink Path Geometry For High Temperature Operation Of Ink-Jet Printheads, describes altering the dimensions of the ink-jet feed channel to provide fluidic drag. U.S. Pat. No. 5,420,627, to Keefe et al, entitled Ink Jet Printhead, shows a particular printhead design.

Typically, such a conventional ink-jet printhead utilizes a high temperature generated by a heating resistor layer to spray an ink outside. However, when the high temperature influences upon an ink for a great amount of time, thermal changes may occur in the components of the ink, which results in a reduced durability of a device containing the ink, for example, an ink chamber.

Recently, in order to overcome such a problem of reduced durability, a new type of micro-injection device has been developed in which a plate-shaped membrane is applied between the heating resistor layer and the ink chamber. The dynamic deformation of the membrane is induced by the vapor pressure of a working liquid filled in a heating chamber so that the ink in the ink chamber can be efficiently sprayed out. In this case, the membrane inserted between the ink chamber and the heating resistor layer prevents the heating resistor layer from being brought in direct contact with the ink, thereby minimizing any thermal changes of the ink. An example of this type of printhead is seen in U.S. Pat. No. 4,480,259, to Kruger et al., entitled Ink Jet Printer With Bubble Driven Flexible Membrane.

Accordingly, the ink-jet printhead including a membrane is formed by overlaying the heating resistor layer, the heating chamber, the membrane, the ink chamber and the nozzles on a substrate of, for example, a silicon material. In such an inkjet printhead, the heating resistor layer formed on the substrate and defined by a heating chamber barrier layer is supplied with electric energy from outside by contacting with an electrode layer. However, since the electrode layer is in contact with the substrate as well as the heating resistor layer, there is a problem that the electric energy flowing through the electrode layer is leaked out through the substrate.

In the prior art, to prevent the leakage of the electric energy through the substrate, a protective layer of, for example, $SiO_2$ is formed on the substrate so that the electrode layer can be insulated from the substrate and thereby the electric energy flowing through the electrode layer cannot leak out through the substrate. At this time, the protective layer is brought in contact with all of the electrode layer, the heating resistor layer, the heating chamber barrier layer.

Typically, the heating chamber barrier layer formed on the protective layer is formed of a polyimide material because of the chemical stability of this material with respect to the working liquid filled in the heating chamber, and the protective layer is formed of $SiO_2$, which is quite different from the material of the heating chamber barrier layer, because of the insulation requirement between the electrode layer and the substrate. However, in this case, there is a reduced cohesion of the heating chamber barrier layer and the protective layer due to the difference in the materials.

Due to the reduced cohesion of the heating chamber barrier layer and the protective layer, a gap is formed between the heating chamber barrier layer and the protective layer. As a result, the working liquid filling the heating chamber flows through the gap and leaks to the protective layer.

In this case, the leaking working liquid erodes the protective layer and the protective layer is damaged. As a result, the insulation capability of the protective layer is markedly reduced. As temperature and humidity are frequently changed, the cohesion of the heating chamber barrier layer and the protective layer is enormously reduced.

As mentioned above, when a firm cohesion of the heating chamber barrier layer and the protective layer is not present, the heating chamber barrier layer cannot be firmly formed on the protective layer. As a result, the finally formed heating chamber barrier layer has an inequality in the thickness.

At this time, if a thermal treatment for improving the durability of the heating chamber barrier layer is further added, the cohesion of the protective layer and the heating chamber barrier layer is further greatly reduced. As a result, the general printing quality of the printhead is markedly reduced.

SUMMARY OF THE INVENTION

Therefore, it is an object of the present invention to provide an improved micro-injection device.

It is also an object of the present invention to provide a micro-injection device with enhanced cohesion between the protective layer and the heating chamber barrier layer.

It is a further object of the present invention to provide a micro-injection device in which the working liquid is prevented from leaking out.

It is a still further object of the present invention to prevent loss of the insulation capability of the protective layer.

It is yet further object of the present invention to enhance the resistance of the heating chamber barrier layer to humidity and changes in the temperature.

It is still another object of the present invention to achieve a heating chamber barrier layer having a uniform thickness.

To achieve the above objects and other advantages, the present invention provides a cohesion promoting layer formed between the protective layer and the heating chamber barrier layer so that the cohesion of the protective layer and the heating chamber barrier layer is enhanced. The cohesion promoting layer is formed of a liquid of an isooctane system. Preferably, the cohesion promoting layer is formed of a γ-aminopropyltriethoxysilane solution. The γ-aminopropyltriethoxysilane solution is formed of 2,2,4-trimethylpentane liquid in which $NH_2.(CH_2)_3.Si(OCH_2CH_3)_3$ liquid is mixed at a concentration of several percent. Preferably, the chemical constituent of the 2,2,4-trimethylpentane liquid is $(CH_3)_3.CCH_2.CH(CH_3)_2$. The $NH_2.(CH_2)_3.Si(OCH_2CH_3)_3$ is mixed in the 2,2,4-trimethylpentane liquid at, preferably, 3 to 4 percent by weight.

Therefore, according to the present invention, the cohesion of the protective layer and the heating chamber barrier layer can be remarkably enhanced. The other objects of the present invention will be more apparent from the following detailed description and the accompanying drawings.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

The objects, characteristics and advantages of the above-described invention will be more clearly understood through the preferable embodiments by reference to the attached drawings. Terminologies of the elements of the invention which will be used hereinafter are defined based on the respective functions thereof. It is however apparent that the terminologies can be varied according to the intention or the convention of those who are skilled in the art. Therefore, the definitions of the terminologies should be understood throughout the contents of the present invention.

Figure 1:
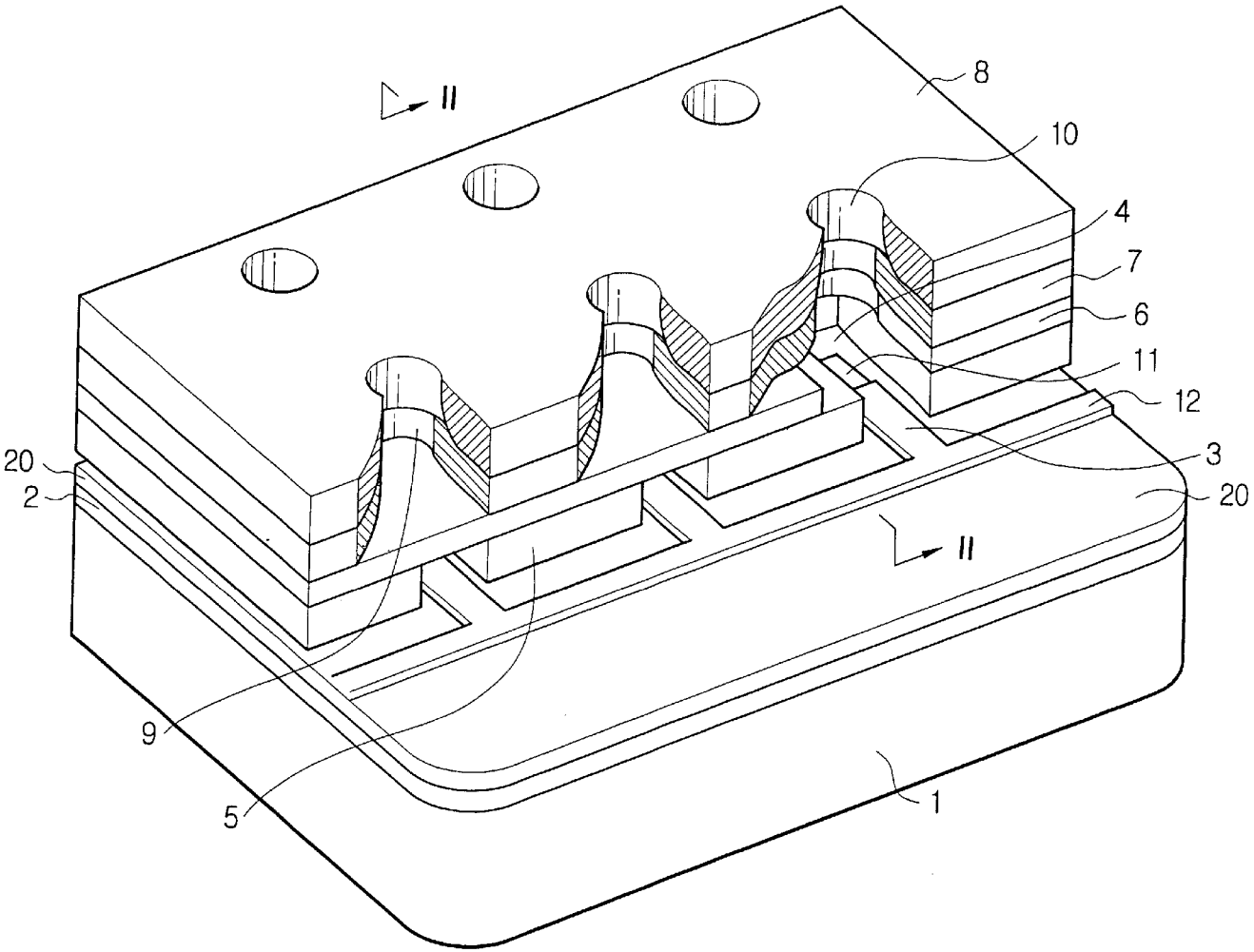
FIG. 1 is a perspective view of an ink-jet printhead according to the present invention.
Figure 2:
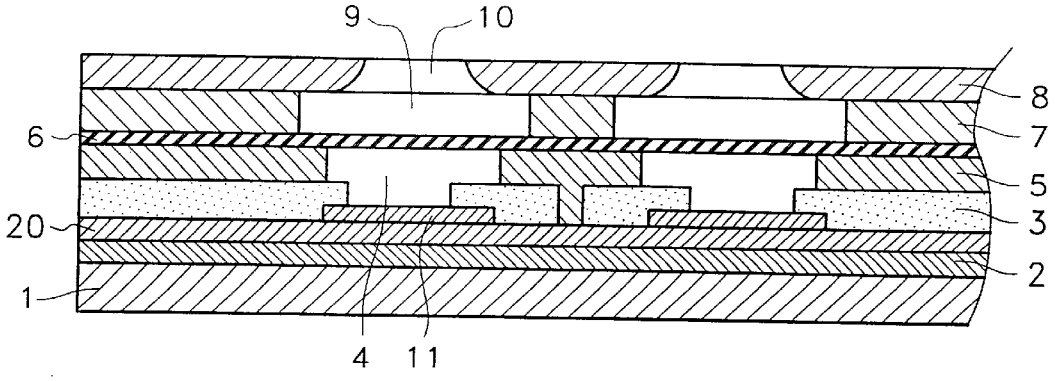
FIG. 2 is a cross-sectional view taken along lines II—II of FIG. 1.

The ink-jet printhead according to the present invention will now be described with reference to the accompanying drawings. As shown in FIGS. 1 and 2, the ink-jet printhead according to the present invention includes a substrate 1 of, for example, a Si material. A protective layer 2 of a $SiO_2$ material is formed on the substrate 1. A heating resistor layer 11 that is heated by an electric energy supplied from outside the ink-jet printhead is formed on the protective layer 2. On the heating resistor layer 11, an electrode layer 3 for supplying the heating resistor layer 11 with the electric energy from outside is formed. The electrode layer 3 is connected to a common electrode 12 and the electric energy supplied from the electrode layer 3 is converted into a thermal energy through the heating resistor layer 11.

On the other hand, a heating chamber barrier layer 5 is formed over the electrode layer 3 so as to form a heating chamber 4 in such a manner that the heating chamber 4 encloses the heating resistor layer 11. The thermal energy converted through the heating resistor layer 11 is transmitted to the heating chamber 4.

Here, a working liquid which readily generates a vapor pressure is filled in the heating chamber 4. The working liquid is rapidly gasified by the thermal energy transmitted from the heating resistor layer 11. In addition, the vapor pressure generated by the gasification of the working liquid is transmitted to a membrane 6 formed on the heating chamber barrier layer 5.

On the membrane 6, an ink chamber (or liquid chamber) barrier layer 7 is formed so as to form an ink chamber (or liquid chamber) 9 coaxial with the heating chamber 4. A predetermined amount of ink is filled in the ink chamber 9.

A nozzle 10 is formed on the ink chamber barrier layer 7 in such a manner that the nozzle 10 caps the ink chamber 9. The nozzle 10 serves as a jet gate for dropping the ink outwardly. The nozzle 10 is formed through a nozzle plate 8 on the ink chamber barrier layer 7 to be coaxial with the heating chamber 4 and the ink chamber 9.

In the inventive micro-injecting device, a cohesion promoting layer 20 which is a major point of the present invention is formed between the protective layer 2 and the heating chamber barrier layer 5. The cohesion promoting layer 20 is formed on the protective layer 2 and brought in contact with all of the heating resistor layer 11, the electrode layer 3, the heating chamber barrier layer 5. Thereby, the cohesion promoting layer 20 functions to enhance the cohesion of the protective layer 2 and the heating chamber barrier layer 5. Accordingly, even though the high temperature and high humidity adversely affect the boundary surface between the protective layer 2 and the heating chamber barrier layer 5 for a great amount of time, the protective layer 2 and the heating chamber barrier layer 5 do not separate from each other.

In the prior art, due to the differences in the materials of the protective layer and the heating chamber barrier layer, a gap having a predetermined size is formed between the protective layer and the heating chamber barrier layer. In this case, the working liquid filling the heating chamber leak out toward the protective layer through the gap. As a result, the insulation capability of the protective layer is remarkably reduced.

However, in the present invention, as explained above, the cohesion promoting layer 20 formed between the protective layer 2 and the heating chamber barrier layer 5 functions to enhance the cohesion of the protective layer 2 and the heating chamber barrier layer 5. With the enhanced cohesion, the gap formation between the protective layer 2 and the heating chamber barrier layer 5 can be prevented in advance. Therefore, the working liquid filling the heating chamber 4 is prevented from leaking toward the protective layer 2. Accordingly, the insulation capability of the protective layer 2 can be maintained for a long time.

Preferably, the cohesion promoting layer 20 is formed from a solution of isooctane system, for example, 2,2,4-trimethylpentane solution by a spin-coating technology. The 2,2,4-trimethylpentane solution has a chemical formula of $(CH_3)_3.CCH_2.CH(CH_3)_2$.

Preferably, when 2,2,4-trimethylpentane solution is used as the coating liquid for the cohesion promoting layer 20, γ-aminopropyltriethoxysilane solution can be added thereto in order to promote the cohesion still more. The γ-aminopropyltriethoxysilane has a chemical formula of $NH_2.(CH_2)_3.Si(OCH_2CH_3)_3$. Preferably, the concentration of γ-aminopropyltriethoxysilane is in the range of approximately 3 to 4 percent by weight. The γ-aminopropyltriethoxysilane is a subsidiary, substance of the cohesion promoting layer which can produce an aminopropyl derivative of the $SiO_2$ protective layer.

In the present invention, since the cohesion promoting layer 20 for enhancing the cohesion of the protective layer 2 and the heating chamber barrier layer 5 is formed on the protective layer 2 before the heating chamber barrier layer 5 is formed, the cohesion of the protective layer 2 and the heating chamber barrier layer 5 can be firmly maintained even though a high temperature thermal treatment process for improving the durability of the heating chamber barrier layer 5 is performed after the heating chamber barrier layer 5 is formed. As a result, processes can be performed in the stable state and accordingly, the heating chamber barrier layer 5 has a uniform thickness.

Figure 3:
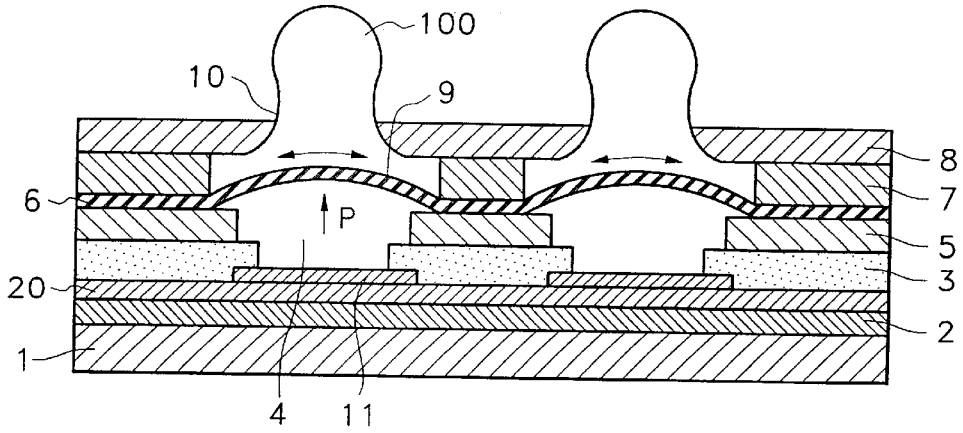
FIG. 3 is a view illustrating a first operating state of the present invention.

The operation of the ink-jet printhead having the above-described structure will be described hereinafter. As shown in FIG. 3, first, an electrical signal is supplied to the electrode layer 3 from an external power supply. Then the heating resistor layer 11 in contact with the electrode layer 3 is supplied with an electric energy and instantaneously heated up to a high temperature of more than 500° C. In the heated process, the electric energy is converted into a thermal energy of 500 to 550° C.

Thereafter, the converted thermal energy is transmitted to the heating chamber 4 in contact with the heating resistor layer 11. The working liquid filled in the heating chamber 4 is rapidly gasified by the transmitted thermal energy and generates a predetermined vapor pressure.

At this time, as mentioned above, since the cohesion promoting layer 20 is formed in between protective layer 2 and the heating chamber barrier layer 5 for preventing gap formation between these layers, the working liquid filling the heating chamber 4 does not leak toward the protective layer 2. Accordingly, the protective layer 2 can be prevented from being damaged and can provide fill insulation capability.

Then, the vapor pressure is transmitted to the membrane 6 formed on the heating chamber barrier layer 5 and accordingly, a predetermined impact P is given to the membrane 6. In this process, the membrane 6 is rapidly expanded upwardly as indicated by the arrow of FIG. 3 and is bowed roundly. Accordingly, a strong impact is given to the ink 100 filled in the ink chamber 9 formed on the membrane 6 and the ink 100 is bubbled and about to be sprayed.

Figure 4:
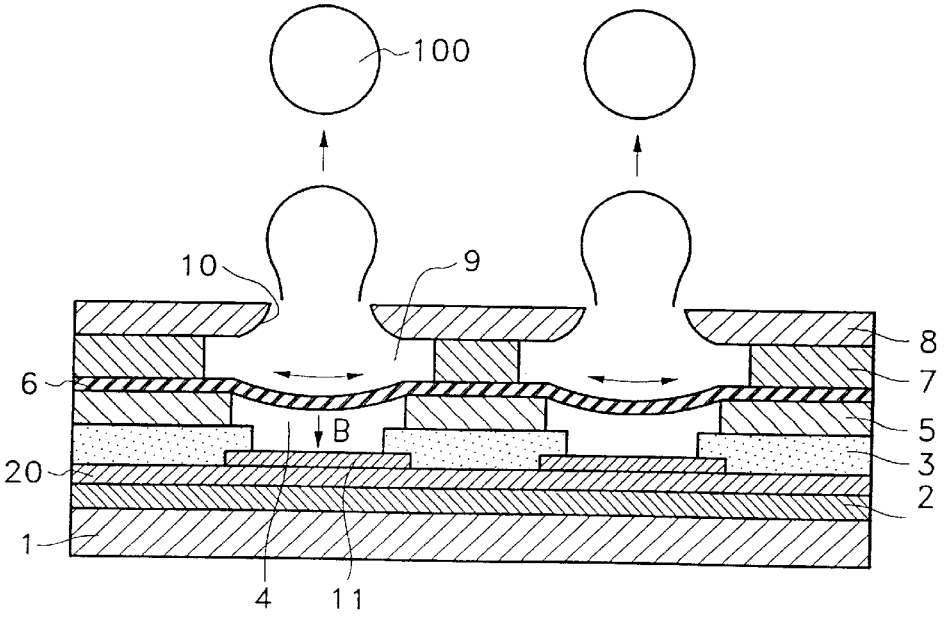
FIG. 4 is a view illustrating a second operating state of the present invention.

By contrast, under the condition, as shown in FIG. 4, when the heating resistor layer 11 is rapidly cooled by blocking the electrical signal which has been supplied from the external power supply, the vapor pressure maintained in the interior of the heating chamber 4 is rapidly reduced. Accordingly, the interior of the heating chamber 4 is promptly depressurized. The resulting vacuum provides the membrane 6 with a buckling force B opposite to the above-described impact, whereby the membrane 6 is instantaneously contracted and initialized.

In this case, the membrane 6 rapidly contracts downward as indicated by the arrow of FIG. 4 and a strong buckling force is transmitted into the interior of the ink chamber 9. Accordingly, through the expanded process of the membrane 6, the ink 100 that is about to be sprayed is efficiently changed into an elliptical shape and a circular shape by its own weight and thus the ink 100 is sprayed out onto an external printing paper. In this manner, a rapid printing operation on the external printing paper is performed.

As described above, a cohesion promoting layer for enhancing the cohesion of the protective layer and the heating chamber barrier layer is formed between the protective layer and the heating chamber barrier layer. The cohesion promoting layer is capable of maintaining a firm cohesion of the protective layer and the heating chamber barrier layer for a long time. Accordingly, the general printing performance of the ink-jet printer can be markedly enhanced.

As aforementioned, the present invention can be applied to any micro-injecting device, for example, a micro-pump for medical appliance and a fuel-injecting device, without any degradation of the efficiency. As aforementioned, the ink-jet printhead according to the present invention includes a cohesion promoting layer of an isooctane system between the protective layer and the heating chamber barrier layer, whereby the cohesion of the protective layer and the heating chamber barrier layer can be enhanced. Therefore, the general printing performance of the ink-jet printer can be markedly enhanced.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A micro-injecting device, comprising:

a substrate made of silicon;

a protective layer of $SiO_2$ disposed on said substrate;

a cohesion promoting layer disposed on said protective layer, for enhancing the cohesion of said protective layer with a heating chamber barrier layer;

a heating resistor layer disposed on a portion of the cohesion promoting layer, for heating a heating chamber;

an electrode layer disposed on a portion of the cohesion promoting layer and contacting the heating resistor layer, for providing electricity from an external source to the heating resistor layer;

a heating chamber barrier layer disposed on the cohesion promoting layer, said heating chamber barrier layer defining a heating chamber surrounding the heating resistor;

a membrane layer overlaying the heating chamber barrier layer, for transmitting a volume change of working fluid in the heating chamber upon heating of the working fluid;

a liquid chamber barrier layer disposed on the membrane, said liquid chamber barrier layer defining a liquid chamber coaxial with the heating chamber; and a nozzle plate disposed on the liquid chamber barrier layer, said nozzle plate having a nozzle aligned with the liquid chamber.

2. The micro-injecting device of claim 1, said cohesion promoting layer being formed by treatment of said protective layer with a treatment liquid comprising an isooctane.

3. The micro-injecting device of claim 2, said treatment further comprising spin-coating the treatment liquid on said protective layer.

4. The micro-injecting device of claim 2, said isooctane being 2,2,4-trimethylpentane.

5. The micro-injecting device of claim 2, said treatment liquid further comprising γ-aminopropyltriethoxysilane.

6. The micro-injecting device of claim 5, said treatment liquid being a solution of γ-aminopropyltriethoxysilane in an isooctane solvent.

7. The micro-injecting device of claim 6, said treatment liquid being a solution of γ-aminopropyltriethoxysilane in 2,2,4-trimethylpentane.

8. The micro-injecting device of claim 6, the concentration of γ-aminopropyltriethoxysilane in the solution being in the range of approximately 3 to 4% by weight.

9. The micro-injecting device of claim 7, the concentration of γ-aminopropyltriethoxysilane in the solution being in the range of approximately 3 to 4% by weight.

10. The micro-injecting device of claim 1, said cohesion promoting layer comprising an aminopropyl derivative of the $SiO_2$ of said protective layer.

11. A micro-injecting device, comprising:

a substrate made of silicon;

a protective layer of $SiO_2$ disposed on said substrate;

a layer of isooctane disposed on said protective layer, forming a cohesion promoting layer for enhancing the cohesion of said protective layer with a heating chamber barrier layer;

a heating resistor layer disposed on a portion of the cohesion promoting layer, for heating a heating chamber;

an electrode layer disposed on a portion of the cohesion promoting layer and contacting the heating resistor layer, for providing electricity from an external source to the heating resistor layer;

a heating chamber barrier layer disposed on the cohesion promoting layer, said heating chamber barrier layer defining a heating chamber surrounding the heating resistor;

a membrane layer overlaying the heating chamber barrier layer, for transmitting a volume change of working fluid in the heating chamber upon heating of the working fluid;

a liquid chamber barrier layer disposed on the membrane, said liquid chamber barrier layer defining a liquid chamber coaxial with the heating chamber; and a nozzle plate disposed on the liquid chamber barrier layer, said nozzle plate having a nozzle aligned with the liquid chamber.

12. The micro-injecting device of claim 11, said isooctane being 2,2,4-trimethylpentane.

13. The micro-injecting device of claim 11, said isooctane layer being formed on the protective layer by a spin-coating process.

14. The micro-injecting device of claim 13, said spin-coating process comprising spin-coating a liquid comprising 2,2,4-trimethylpentane on the protective layer.

15. The micro-injecting device of claim 14, said liquid further comprising γ-aminopropyltriethoxysilane.

16. The micro-injecting device of claim 15, the concentration of γ-aminopropyltriethoxysilane in 2,2,4-trimethylpentane being in the range of approximately 3 to 4% by weight.

* * * * *